United States Patent [19]

Saunders et al.

[11] 4,049,006

[45] Sept. 20, 1977

[54] HAIR-WEAVING DEVICE

[76] Inventors: Proxy G. Saunders, 9129 Phillips Ave., Chicago, Ill. 60617; Lorine Moorman, 554 E. 92nd Place, both of Chicago, Ill. 62223

[21] Appl. No.: 684,769

[22] Filed: May 10, 1976

[51] Int. Cl.[2] ..... A41G 3/00

[52] U.S. Cl. ..... 132/5

[58] Field of Search ..... 132/5, 56; 112/79.5, 112/222, 170; 66/116–121; 46/172; 28/72.2 R

[56] References Cited

U.S. PATENT DOCUMENTS

| | | | |
|---|---|---|---|
| 3,882,804 | 5/1975 | Matsumura | 132/5 |
| 3,903,903 | 9/1975 | Matsumura | 132/5 |

*Primary Examiner*—G.E. McNeill

[57] ABSTRACT

A hair-weaving machine includes two endwise juxtaposed threaded shafts having a gap formed therebetween and two arms provided with grippers which may be rotated in a clockwise and anticlockwise directions around the shafts, respectively. As the arms are slowly advanced in the same directions longitudinally along the respective shafts, one arm with its gripper pushes a needle-attached thread through an endportion of a hairpiece and past a strand of hairs, while the other arm and its associated gripper grips the needle after the latter has been pushed through the endportion of the hairpiece and past the strand of hairs, and returns the needle and its associated thread subsequently to the first arm. The next action of the first gripper arm results in a complete loop being formed around the hairpiece endportion and the strand of natural hairs, subsequent loops being formed as the arms are advanced longitudinally along the respective shafts. A spool with a torsion spring attached to the frame of the machine keeps the thread tout at all times, which results in the formation of tight loops.

10 Claims, 7 Drawing Figures

HAIR-WEAVING DEVICE

BACKGROUND OF THE INVENTION

1. Field of the Invention

The field of the present invention relates to a hair-weaving machine.

2. Description of the Prior Art

Manual weaving of one or several hairpieces 118 or portions thereof onto a strand of natural hairs 12 of a partially bald head 11, as illustrated in FIG. 1 is time consuming. Means have therefore been sought of implementing this operation automatically to save time and expense.

SUMMARY OF THE INVENTION

In order to save both time and cost, I accordingly provide a hair-weaving machine for attaching a hairpiece having an endportion to a strand of natural hairs. The machine includes first holding means for gripping and forcing a needle through the endportion of the hairpiece and past the strand of hairs; the needle is released from the first holding means upon having been forced through the endportion of the hairpiece and past the strand of hairs. I provide second holding means for gripping the needle upon the latter having forced through the endportion of the hairpiece and past the strand of hairs, and for guiding the needle to the first holding means. The needle is released from the second holding means when in the vicinity of the first holding means and is gripped by the latter upon release from the second holding means. A thread-tension producing means is provided for creating a tension in the needle-attached thread so that a tight loop of the thread is formed around at least part of the endportion of the hairpiece, and at least part of the strand of hairs upon the needle having been forced through the endportion of the hairpiece and past the strand of hairs at least a second time. The needle with the thread attached thereto may alternately also be forced through the strand of hairs.

The machine includes first and second threaded shafts which have substantially a common axis and which are endwise juxtaposed with one another; a gap is formed between the shafts. The first and second holding means are first and second holders, which may be rotated around the first and second shafts, respectively.

Driving means in the form of first and second electric motors disposed in the vicinity of the first and second shafts are provided for rotating the latter and for selectively driving the first and second holders, respectively, in clockwise and counterclockwise directions. The shafts are preferably flexible and rotation of the first and second threaded shafts causes an additional translational motion of the first and second holders along the first and second shafts, respectively.

Each of the electric motors has first and second portions which may be driven simultaneously in clockwise and counterclockwise directions. A plurality of coupling means are provided for selectively coupling the first and second holders to the first and second portions, respectively; the coupling means is preferably a magnetic clutch.

Each of the holders is telescopically extensible in a longitudinal direction along the shafts so as to be able to be coupled to the coupling means, respectively. The thread-tension producing means includes a thread-holding spool and a torsion spring which has two ends; one of the ends is attached to the spool and the other of the ends is attached to a frame of the machine for urging the spool to keep the thread tout.

BRIEF DESCRIPTION OF THE DRAWING

My invention will be better understood with reference to the accompanying drawing in which.

DESCRIPTION OF THE PREFERRED EMBODIMENT

Figure 2:
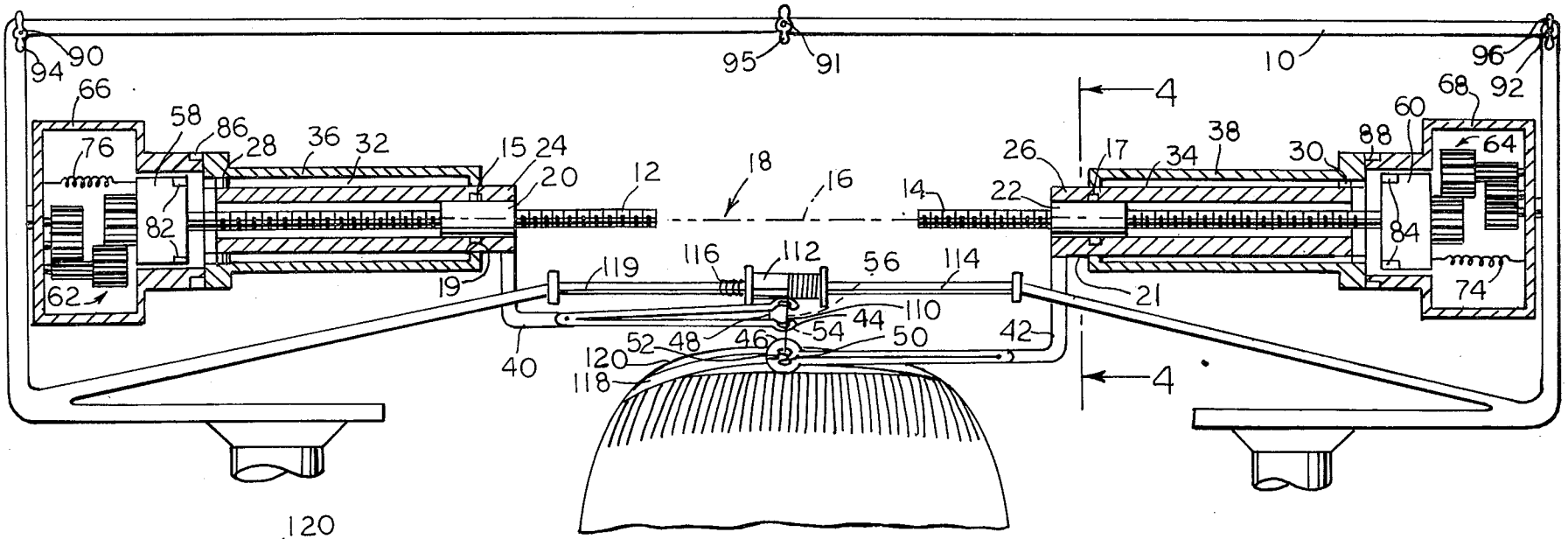
FIG. 2 shows an elevational view of a hair-weaving machine according to my invention, in partial cross-section.

Referring now to the drawing, a C-shaped frame 10 has rotatably mounted thereon two longitudinal threaded and flexible shafts 12 and 14, which have substantially a common axis 16 and are endwise juxtaposed with one another, a gap 18 being formed between the shafts 12 and 14. Two threaded bushings 20 and 22 are mounted and rotatable on and around shafts 14 and 16, respectively and are provided with pins 15 and 17. Sleeves 24 and 26 are rotatably mounted on bushings 20 and 22 being formed with grooves 19 and 21 for receiving respective pins 15 and 17, and are in turn provided with pins 28 and 30 which can slide lengthwise within longitudinal grooves 32 and 34 formed in sleeves 36 and 38, so that the sleeves 24 and 26 can be telescopically extended from the sleeves 36 and 38, respectively. Rotation of sleeves 36 and 38 will also cause a rotation of sleeves 24 and 26, respectively. Arms 40 and 42 are mounted on sleeves 24 and 26 respectively. Arms 40 and 42 are provided with gripping clamps 44 and 46, respectively, which are normally held open by respective springs 48 and 50. Each of the gripping clamps 44 and 46 is made of magnetic material and is hingeably closeable around a needle 52 upon actuation of respective electromagnets 54 and 56. External to the C-shaped frame 10 there are mounted electric motors 58 and 60 which are synchronizable with one another, being, for example, synchronous motors. Gear trains 62 and 64 coupled to motors 58 and 60 respectively, provide for rotation of longitudinal shaped bodies 66 and 68 which fit concentrically over the latter in directions respectively opposite to that of motors 58 and 60. The latter can slide in a longitudinal direction towards and away from the centre of the frame 10, being normally held remote from frame 10 by respective compression springs 74 and 76. Electromagnets 82 and 84 are disposed on motors 58 and 60, and electromagnets 86 and 88 are disposed on cylindrically-shaped bodies 66 and 68, respectively. Electromagnets 82, 84, 86, and 88 act as magnetic clutches, i.e. by energizing either magnets 82, and 84, or magnets 86, and 88, the bushings 20 and 22 can be made to rotate in either clockwise or anticlockwise directions, as seen from one lateral end of the hair-weaving machine, provided motors 58 and 60 are running. Hinges 90, 91 and 92, which can be tightened by respective thumbscrews 94, 95 and 96 may optionally be provided on the frame 10 to allow for slight inclinations of shaft 12 with respect to shaft 14. The latter are permanently coupled to motors 58 and 60, respectively via non-illustrated internal reduction gears within the motors, so that upon operation of the latter the bushings 20 and 22 are made to execute a translatory motion along respective shafts 12 and 14.

Figure 3:
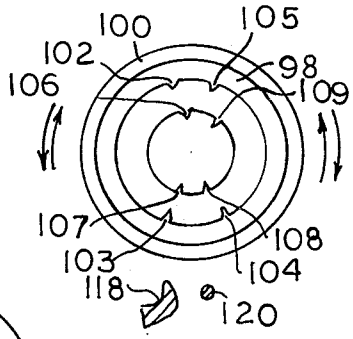
FIG. 3 shows timing discs of the hair-weaving machine.

The timing of the operation is controlled by a timing disc 98 attached to one of the motors 58 and 60 and shown in FIG. 3. The position of the disc 98 with respect to a corresponding stationary disc 100 rigid with the frame 10 controls the occurrance of certain events. Thus there is an actuating contact 102 for commanding clockwise motion of, for example, the arm 40, an actuating contact 103 for commanding counterclockwise motion of the arm 40, an actuating contact 104 for commanding counterclockwise motion of, for example the arm 42, an actuating contact 105 for commanding clockwise motion of the arm 42, an actuating contact 106 for commanding, for example, the clamp 44 to grip the needle 52, an actuating contact 107 for commanding the clamp 44 to release its grip from the needle 52, an actuating contact 108 to commanding the clamp 46 to grip the needle 52, and an actuating contact 109 for commanding the clamp 46 to release its grip from the needle 52. The needle 52 is always gripped on one of its ends by either the clamp 44 or by the clamp 46.

A thread 110 is attached to the needle 52 which may be unwound from a spool 112. The latter is free to slide longitudinally along a bar 114 rigid with the frame 10. A torsion spring 116 is free to slide with one end thereof in a longitudinal groove 119 of the bar 114, and is attached with the other end thereof to the spool 112. The thread 110 will therefore tend to always be held taut due to the action of the torsion spring 116.

Figure 7:
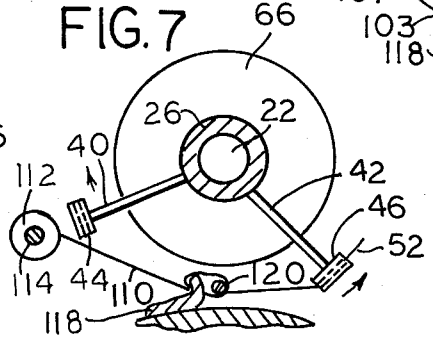
FIGS. 4 - 7 show sideviews in fragmentary cross-section of the hair-weaving machine at different positions of the operating cycle.
Figure 6:
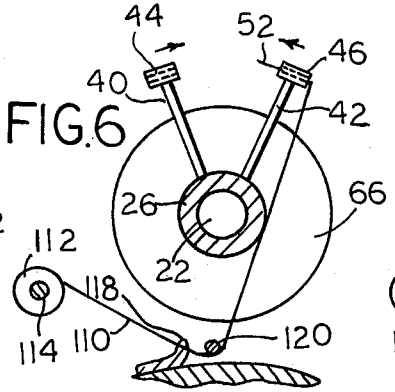
Figure 5:
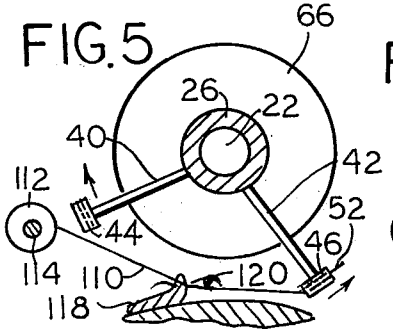
Figure 1:
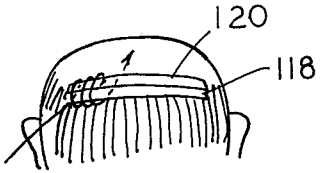
FIG. 1 shows a method of hair-weaving according to the prior art.
Figure 4:
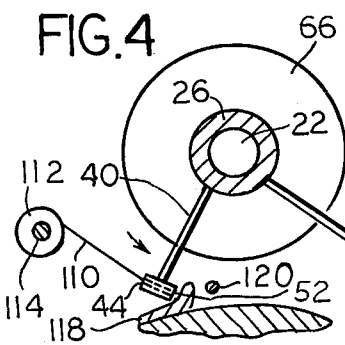

The operation of the machine is as follows: Let it be assumed that the clamp 44 of the arm 40 has clamped one end of the needle 52, the arm 40 being in a counterclockwise motion— where the very first clamping action has to be set manually and that the needle 52 is about to penetrate the endportion of a hairpiece 118 and pass below a strand of hairs 120. Upon the needle 52 passing beyond or through the strand of hairs 120, the clamp 44 is commanded to release the needle 52, and the arm 40 is commanded to move in a clockwise direction. Simultaneously the clamp 46 of the arm 42 is commanded to grip the needle 52 at its other end, while the arm 42 is commanded to rotate in a counterclockwise direction. In the vicinity of the meeting point of the arms 40 and 42, the former moving in a clockwise direction, the clamp 46 is commanded to release its grip from the needle 52 and the clamp 44 is commanded to grip the needle 52, while the arm 40 is simultaneously commanded to rotate in a counterclockwise direction, and the arm 42 is commanded to rotate in a clockwise direction. While this happens the thread 110 unwinding from the spool 112 is at first passing through the endportion of the hairpiece 118 and below or through the strand of hairs 120, i.e. executing a left-to-right motion as seen in FIG. 5. Upon the arm 42 with its clamp 46 gripping the needle 52, the left-to-right motion of the thread 110 continues for a while, but is then reversed into a right-left motion, and when the needle 52 is released from the clamp 46 and gripped by the clamp 44 of the arm 40, the thread 110 starts its initial left-right motion anew. In executing this sequence of motions a first tight loop is formed by the thread 110 around the endportion of the hairpiece 118 and the strand of hairs 120 as best seen in FIG. 7, and second subsequent similar loops are formed as the arms 40 and 42 continue to advance longitudinally across respective shafts 12 and 14 as a result of the slow rotation of the latter by the motors 58 and 60.

The disclosed embodiments are representative of presently preferred forms of the invention but are intended to be illustrative rather than definitive. The invention is defined by the appended claims.

What is claimed is:

1. A hair-weaving machine for attaching a hairpiece having an endportion to a strand of hairs comprising:

first holding means for gripping and forcing a needle having a thread attached thereto through the end portion of said hairpiece past the strand of hairs, the needle being releasable from said first holding means upon having been forced through said endportion of said hairpiece and past the strand of hairs;

second holding means for gripping the needle upon the latter having been forced through said endportion of said hairpiece and past the strand of hairs, and for guiding the needle to said first holding means, the needle being releasable from said second holding means upon being in the vicinity of said first holding means and grippable by the latter upon release from said second holding means; and thread-tension producing means for creating a tension in a needle-attached thread so that a tight loop of the thread is formed around at least part of said endportion of said hairpiece and at least part of the strand of hairs upon the needle being forced through the endportion of said hairpiece and past the strand of hairs at least a second time.

2. A hair-weaving machine according to claim 1 wherein the needle is forced through the strand of hairs.

3. A hair-weaving machine according to claim 1 further comprising first and second threaded shafts having substantially a common axis and being endwise juxtaposed with one another, a gap being formed therebetween, and wherein said first and second holding means are first and second holders rotatable around said first and second shafts, respectively.

4. A hair-weaving machine according to claim 3 further comprising driving means for rotating said first and second shafts and for rotating said first and second holders around said first and second shafts, respectively.

5. A hair weaving machine according to claim 4 wherein said driving means are first and second electric motors disposed in the vicinity of said first and second shafts for selectively driving said first and second holders, respectively, in clockwise and counterclockwise directions, and for rotating said first and second shafts, respectively.

6. A hair-weaving machine according to claim 5 wherein said shafts are flexible and wherein a rotation of said first and second threaded shafts causes an additional translational motion of said first and second holders along said first and second shafts, respectively.

7. A hair-weaving machine according to claim 6 wherein each of said electric motors has first and second portions simultaneously drivable in clockwise and counterclockwise directions, and further comprising a plurality of coupling means for selectively coupling said first and second holders to said first and second portions, respectively.

8. A hair-weaving machine according to claim 7 wherein each of said coupling means is a magnetic clutch.

9. A hair-weaving machine according to claim 8 wherein each of said holders is telescopically extensible in a longitudinal direction along said shafts for being couplable to said coupling means, respectively.

10. A hair-weaving machine according to claim 9 further including a frame, and wherein said thread-tension producing means comprises a thread-holding spool and a torsion spring having two ends, one of said ends being attached to said spool, the other of said ends being attached to said frame for urging said spool to keep the thread taut.

* * * * *